United States Patent [19]

Swindler

[11] 4,362,915

[45] Dec. 7, 1982

[54] ELECTRIC ARC CONFINING DEVICE

[75] Inventor: David L. Swindler, Franklin, Ohio

[73] Assignee: Square D Company, Palatine, Ill.

[21] Appl. No.: 282,361

[22] Filed: Jul. 13, 1981

Related U.S. Application Data

[63] Continuation-in-part of Ser. No. 879,013, Feb. 17, 1978, which is a continuation of Ser. No. 684,052, May 6, 1976.

[51] Int. Cl.[3] ..... H01H 33/08

[52] U.S. Cl. ..... 200/144 R

[58] Field of Search ..... 200/144 R, 144 C, 148 R, 200/148 C, 48 KB, 48 SB, 306, 149 A

[56] References Cited

U.S. PATENT DOCUMENTS

| | | | |
|---|---|---|---|
| 1,912,342 | 5/1933 | Ainsworth | 200/144 R |
| 2,596,983 | 5/1952 | Christensen | 200/144 R |
| 3,243,538 | 3/1966 | Rodeseike | 200/48 KB |
| 3,515,829 | 6/1970 | Hurtle | 200/144 R |
| 3,949,182 | 4/1976 | Teijeiro | 200/148 C |

*Primary Examiner*—Robert S. Macon

*Attorney, Agent, or Firm*—Larry I. Golden; Norton Lesser; Richard T. Guttman

[57] ABSTRACT

An arc chute for a high voltage load interrupter switch has a pair of closely spaced side walls defining an arc chamber. An inner side of each wall has at least one groove between an open outer end of the chamber and an inner area of the chamber where blade contact is first broken resulting in a electrical arc. The longer axes of the grooves are generally perpendicular to the direction of flow of expanding arc gases that form at an inner end of the chamber when the switch is opened under load. The grooves have a semi-teardrop shaped cross section with the deeper portions of the grooves nearer the outer end of the chamber. As the expanding arc gases flow toward the chamber opening, some gas flows into the grooves which function as vortex generators causing the gases to swirl. The swirling gases then reverse direction and impede the flow of additional gases coming from the inner end of the chamber, and increase the pressure within said chamber fostering arc interruption by aiding molecular recombination by reducing the distance between ions.

9 Claims, 6 Drawing Figures

ELECTRIC ARC CONFINING DEVICE

BACKGROUND AND SUMMARY OF THE INVENTION

This application is a continuation-in-part of U.S. patent application Ser. No. 879,013, filed Feb. 17, 1978 entitled ELECTRIC ARC CONFINING DEVICE, now abandoned, which is a continuation of U.S. application Ser. No. 684,052, filed May 6, 1976 entitled ELECTRIC ARC CONFINING DEVICE, now abandoned.

The use of arc chutes for confining and interrupting arcs generated by air-immersed switches is well known. Commonly, the arc is propelled by a magnetic field or other means into an arc chamber of an arc chute where it is elongated to increase the arc resistance until the arc extinguishes. At higher currents and voltages, however, this method alone is inadequate because the arc is blown through the chute before it is interrupted. To protect against such blowouts, some existing arc chambers are effectively elongated within the chamber by means of spaced interleaving ribs or fins extending from opposite side walls of the chamber so as to form a tortuous arc path. Further, the closely confining walls of the arc passage are sometimes made of gas evolving material that produces gas which assists in extinguishing the arc.

In accordance with this invention, an electric arc confining and extinguishing device is provided comprising an arc chute having a pair of closely spaced walls defining an arc chamber. An auxiliary switchblade of a load interrupter switch breaks an electric circuit at arcing contacts positioned near an inner closed end of the chamber after a main switchblade of the load interrupter switch is moved to an open circuit position. Upon opening of the arcing contacts, arc gases at high pressure are produced which flow toward the open end of the chamber. One or more grooves in a inner side of one wall of the chamber and a complementary groove or grooves in an inner side of the other wall are positioned generally perpendicular to the flow of the expanding arc gases. Each groove has a semi-teardrop cross section with the deeper portion of the groove nearer the open end of the chamber so that a vortex is created when gases flow into the grooves. The swirling gases that flow from the grooves back toward the inner end of the chamber because of the vortex effect provide dynamic resistance to the further outward flow of gases and so impede the flow that the extension of the arc beyond the confines of the chute is prevented. The churning gases increase the pressure within the arc chamber which aids in molecular recombination by reducing the distance between ions.

Other objects and advantages of this invention will become apparent from the following description wherein reference is made to the accompanying drawings, in which:

DETAILED DESCRIPTION OF THE INVENTION

Figure 1:
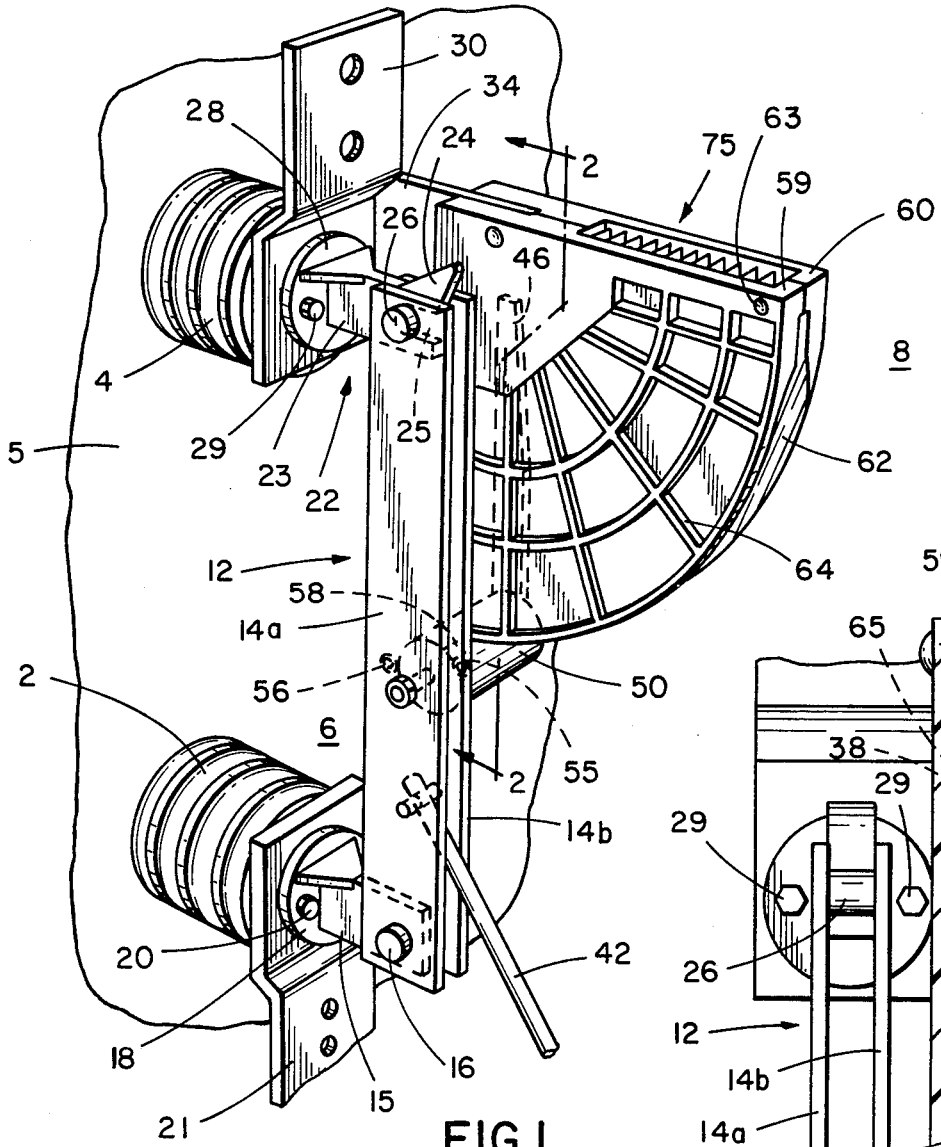
FIG. 1 is a perspective view of a load interrupter switch provided with an arc chute in accordance with this invention.
Figure 6:
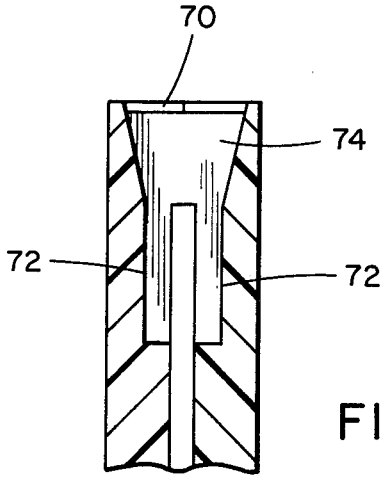
FIG. 6 is a cross sectional view of a portion of the arc chute taken generally along the line 6—6 of FIG. 3.

Referring to the drawings and particularly to FIG. 1, a pair of vertically spaced insulators 2 and 4 secured to a panel 5 support of a load interrupter switch 6 of which an arc chute 8 in accordance with this invention forms a part. The switch 6 includes a main dual switch blade 12 comprising a pair of spaced blade members **14*a* and 14*b* pivotally supported on a hinge tongue 15 by a pivot pin 16. The tongue 15 is preferably integral with a base member 18 which is fastened to the insulator 2 by screws 20. A terminal lug 21 is interposed between the member 18 and the insulator 2**.

At an upper or break end of the switch 6, a main stationary contact 22 is provided in the form of a tongue 23 which, in the closed position of the switch 6, is received snugly between, and is gripped by, the blade members **14*a* and 14*b*. The tongue 23 has an upstanding portion 24 and, at its forward end portion, has a slot 25 for receiving a pin 26 inter-connecting the upper end portions of the blade members 14*a* and 14*b*. The tongue 23 is preferably integral with a base member 28 which is fastened to the insulator 4 by screws 29, and a terminal lug 30 is interposed between the base member 28 and the insulator 4**.

Figure 3:
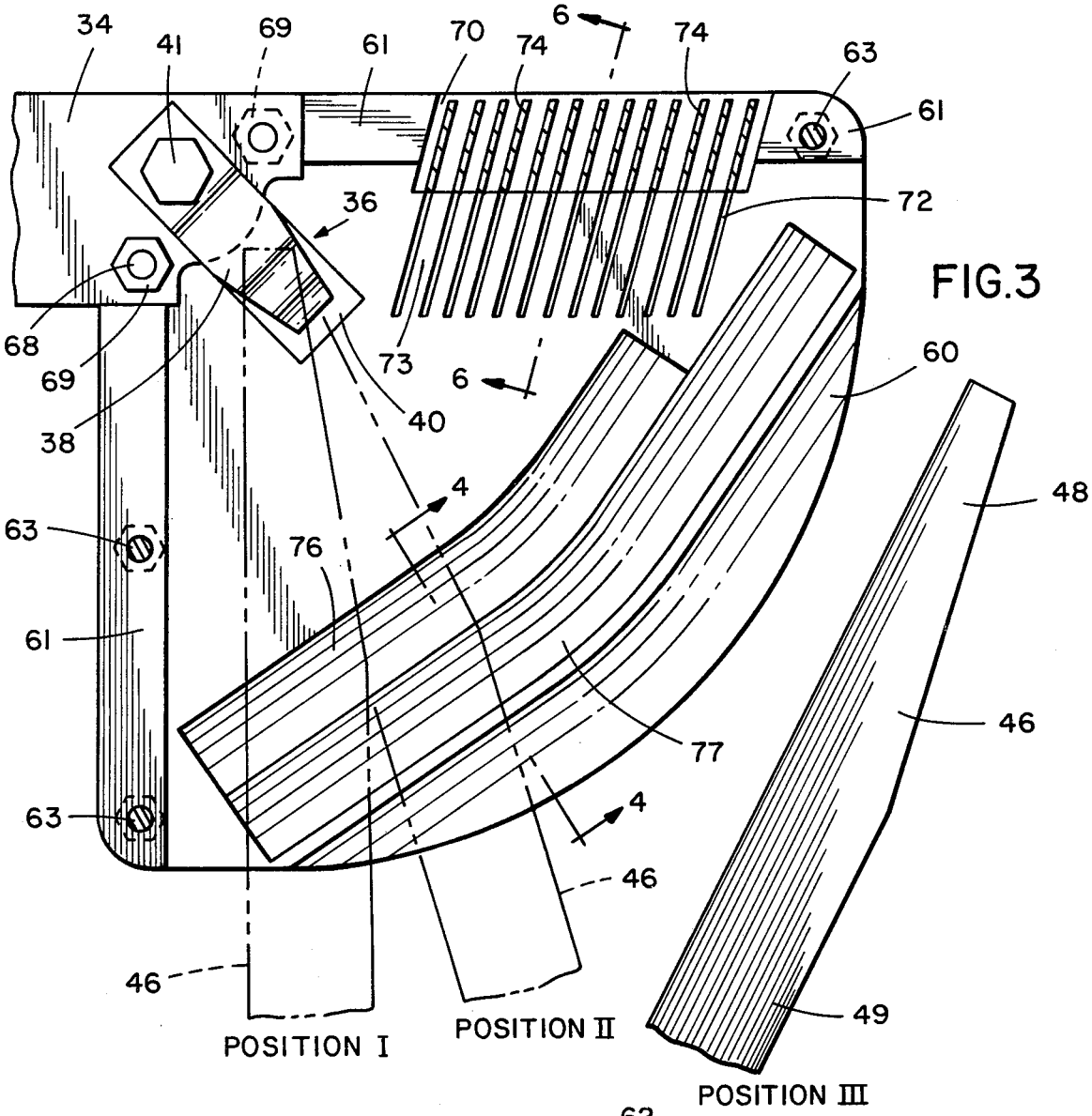
FIG. 3 is a cross sectional view of the arc chute taken generally along the line 3—3 of FIG. 2 and showing an arcing contact blade of the switch in different positions.

As best seen in FIGS. 1 and 3, a flange 34 extends forwardly of the panel 5 from one side of the terminal lug 30 and carries a stationary arcing contact 36 (FIG. 3) comprising a pair of spaced flexible contact members 38 and 40 secured to the flange 34 on opposite sides thereof, respectively, by a bolt and nut 41.

An insulating link 42 is pivotally connected at one end portion to the blade 12 and may be connected at an opposite end portion to a switch drive shaft (not shown) to provide the force required to operate the switch 6 by pivoting the blade 12 about the pivot pin 16.

An auxiliary or arcing switch blade 46 having a tapered outer end portion 48 has its inner end portion 49 non-rotatably secured to a cup-like supporting member 50 which is rotatably mounted on an outer side face 51 of the blade member **14*b* on a pivot bolt 52 which extends through the auxiliary blade 46, the supporting member 50, aligned apertures in the blade members 14*a* and 14*b*, and a spacer 53. A nut 54 is fastened to a threaded end of the bolt 52 at an outerside of the blade member 14*a*. A pair of stops 55 and 56 are secured on the side 51 of the blade member 14*b* and a stop bolt 58 extends radially from the supporting member 50 between the stops 55 and 56. A helical spring (not shown) surrounding the bolt 52 within the supporting member is fixed respectively adjacent opposite ends to bolt 52 and to member or housing 50 and biases the supporting member 50 and blade 46, about the bolt 52 when the blades 12 and 46 pivot relative each other about the axis of pin 52. The stop bolt 58 is then engaged by stop 56 to separate blade 46 from contacts 38 and 40** as will be explained.

In the closed position of the switch 6 as shown in FIG. 1, the blade 12 is in engagement with the contact 22, the outer end portion 48 of auxiliary switch blade 46 is received between the contact members 38 and 40 of the stationary arcing contact 36, as seen in position I of FIG. 3, and the stop bolt 58 is in its normal position in engagement with the stop 55.

When it is desired to open the switch 6, the insulating link 42 is moved in a direction to rotate the main switch blade 12 in a clockwise direction (as viewed in FIG. 1 & 3) about the pivot pin 16 to separate the blade 12 and pin 26 from the contact 22. The outer end portion 48 of the auxiliary blade 46, however, is retained by the contact 36 during initial opening movement of the blade 12 with some sliding and pivoting movement of the tapered or contact end of blade 46 between contacts 38 and 40 to accommodate the rotational movement of the blade 12 so that the current path from the lug 21 to the lug 30 is not interrupted because of the shunt path through the auxiliary blade 46 and the contact 36. During this initial movement of the blade 12, the housing 50 and blade 46 pivot about the axis of pin 52 as relative movement between the main blade 12 and the auxiliary blade 46 occurs and the blade 46 moves from position I to position II of FIG. 3. The relative movement acts to wind or charge the spring (not shown) within the cup-like supporting member 50. As the blade 12 nears its fully opened position, the stop 56 engages the stop bolt 58. Further relative movement between the blades 12 and 46 is thereby prevented, and upon continued movement of the blade 12 in the opening direction, the blade 46 is pulled from its position between the contact members 38 and 40 of the arcing contact 36 and the spring within the supporting member 50 discharges and quickly moves the blade 46 with a snap action through the switch 6 to position III of FIG. 3. The stop bolt 58 is now in its normal position against the stop 55.

To close the switch 6, the link 42 is operated to move the blades 12 and 46 in a counter-clockwise direction from the open position into engagement with the break contact 22 and the arcing contact 36, respectively, to close the circuit through the switch 6. During the closing operation, the blades 12 and 46 are constrained to move together since engagement of the stop bolt 58 with the stop 55 prevents relative movement of the blades 12 and 46.

Switches such as just described are well known in the art. This invention is concerned with the arc chute 8 associated with the contact 36 and the blade 46 for constraining an arc drawn between the contact 36 and the blade 46 when the switch 6 is opened under load.

Figure 2:
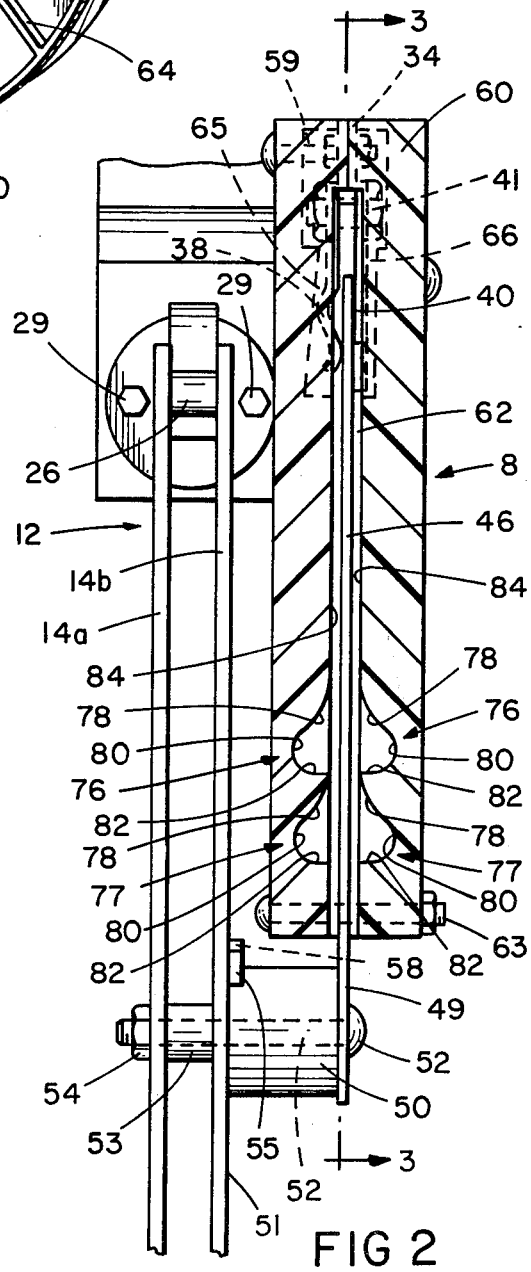
FIG. 2 is a partial cross sectional view of the switch taken generally along the line 2—2 of FIG. 1.

The arc chute 8 has two complementary shaped side walls 59 and 60 connected along raised shouldered areas 61 (FIG. 3) at the top and rear defining an arc chamber 62 therebetween which has a tapered opening 62*a*, best seen in FIG. 2, at an outer lower portion. The width of the chamber 62 is slightly greater than the thickness of the auxiliary switch blade 46 so that the blade 46 can move freely within the arc chamber 62 with a minimum of clearance. The blade 46 itself is preferably made as thin as possible so that the arc chamber 62 may likewise be very narrow. The side walls 59 and 60 are held together by fastening means, such as bolts and nuts 63 extending through the shouldered areas 61 as shown in FIG. 3. Molded ribs 64 on outer surfaces of the side walls 59 and 60 are provided for increased strength.

Referring to FIG. 2, the side walls 59 and 60 have internal recesses 65 and 66, respectively, complementary to, and receiving, the respective contact members 38 and 40 of the arcing contact 36. The chute 8 is secured to the flange 34 by bolts 68 and nuts 69 to form generally closed portions extending from the contact members.

Figure 4:
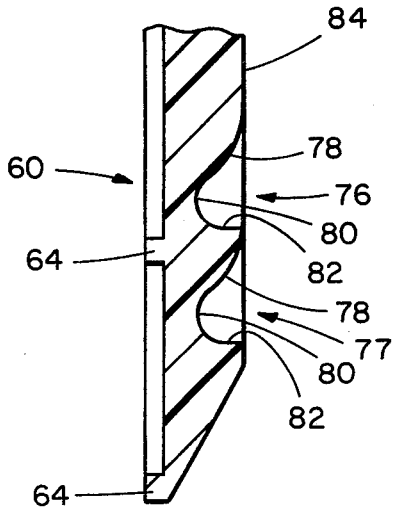
FIG. 4 is a cross sectional view of a portion of one wall of the arc chute taken generally along the line 4—4 of FIG. 3.
Figure 5:
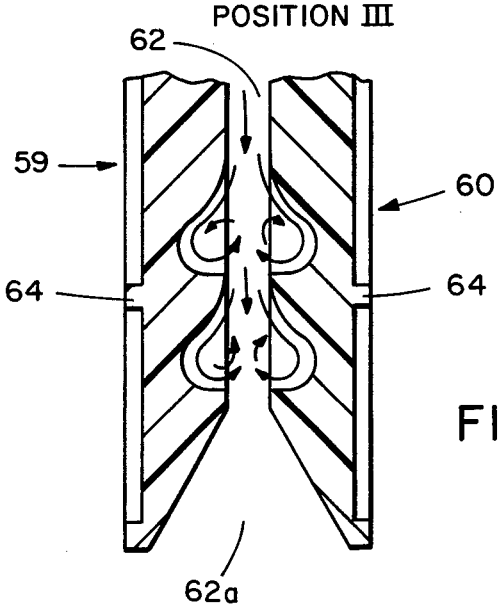
FIG. 5 is a cross sectional view of a portion of the arc chute taken generally along the line 4—4 of FIG. 3 and showing both walls of the arc chute.

In accordance with this invention, a pair of generally parallel curved grooves, an inner groove 76 and an outer groove 77, are formed in each side wall 59 and 60 and are disposed near and along an open end of the arc chute 8. As shown best in FIG. 2, 4, and 5, each vortex generating groove has a convex surface 78 formed by a first wall portion extending transverse to the gas path from the leading edge of the groove and a concave deeper surface portion 80 terminating in an outer side wall 82 that is generally perpendicular to an inner surface 84 of the side walls 59 and 60 at the rear or trailing edge of the grooves to define the boundaries of the grooves. The convex surface 78, the concave deeper portion 80, and the lower side wall 82 define a surface having a semi-teardrop shape. Although it is desirable to make the side wall 82 concave for ease of molding, the wall 82 may be made perpendicular to the surface 84, as shown best in FIG. 2.

In operation, assuming the switch is carrying a current, the circuit is interrupted by pivoting the blade 12 in a clockwise direction about the pivot pin 16 by means of the link 42. The switchblade 12 however, is generally incapable of safely interrupting load current, inasmuch as it depends entirely upon attenuation of the arc formed between an end of the switchblade and the pin 26 when the switchblade is opened to increase the arc voltage and extinguish the arc. Obviously, especially in high voltage applications, if not extinguished by an auxiliary switchblade, such as 46 operating with a snap action, the arc may not be extinguished until the end of the switchblade 12 has been opened a substantial distance even to a position beyond the confines of the chute. Upon the attenuation of the arc beyond the confines of the chute, the arc formed being exposed, may jump to adjacent apparatus or even to the operator.

Upon opening of the switch 6 under load, the separation between the arcing contact 36 and the auxiliary switchblade 46 as previously described causes an arc to be formed that generates gases which flow toward the grooves 76 and 77 near the opening 62*a* of the arc chamber 62. The grooves 76 and 77 are generally parallel to the open end of the chute and transverse or perpendicular to the path of these gases. As the arc gases expand outwardly, they flow along the inner surfaces 84. When the gases arrive at an inner periphery of the groove 76, a relative low pressure air is presented by the volume of air within the grooves 76. According to known principles of fluid mechanics, the gases are drawn into the low pressure area, the gases first flowing along the convex surfaces 78 of the grooves 76 with increasing velocity and then into the concave deeper portions 80. When the gases flow into the grooves 76, the direction of their flow is altered and they flow along the curve defined by the convex surfaces 78, the concave deeper portions 80 and the lower side walls 82. Thus vortices are established, as indicated by the arrows in FIG. 5. After the gases flow along the lower side wall 82 they emerge into the arc chamber 62 in swirling vortices and angularly disposed to its original direction and to the direction of any gases that did not flow into the grooves 76. The creation of such vortices increases the dynamic pressure within the arc chamber and provides a barrier that impedes the flow of the gases out of the tapered opening 62*a* at the outer lower portion of the arc chamber 62. Any arc gases that did not flow into the inner grooves 76 encounter the outer groove 77 where a second group of vortices are formed as described above.

The increase in dynamic pressure within the arc confining device caused by the flow of gases through the vortices aids in molecular recombination by reducing the distance betwen ions and thereby enhancing the arc interruption process.

Although a plurality of grooves, such as 76 and 77, having an additive effect may be provided, any number of grooves in one or both sides of the chamber may provide sufficient increase in pressure within the chamber to aid in extinguishing the arc before it reaches the open end of the chamber.

The arc extinguishing process can be further enhanced by an interrupting mechanism 75 which includes a plurality of metallic plates 74 having trapezoidal upper portions which are received between opposing recesses 70 formed in the top of the walls 59 and 60. These recesses form a passageway at the top of the arc chute providing an exit for arc gases. The metallic plates have rectangular lower portions which are received in respective parallel slots 72 extending downwardly from each of the recesses 70 and inwardly toward the inner portion of arc chamber 62. Gases pass through channels 73 between the plates 74 and exit from the arc chute 8 at the top of recess 70.

It is understood that various modifications may be made in the structure shown and described herein without departing from the spirit and scope of the invention, and it is intended that these modifications are intended to be comprehended within the meaning and range of equivalents of the appended claims.

I claim:

1. An electric arc confining and extinguishing device for a high voltage load interrupter switch including a pivotable arcing blade having a contact end lying along a radial line extending from the pivot of said blade for completing a circuit to a portion of a contact member in response to the engagement of said end with said contact member portion and generating an arc between said contact end and said member in response to the pivoting of said blade to disrupt said circuit with the contact end of said arcing blade following a circumferential blade path about said axis and extending from said contact member, the device comprising an insulating arc chute having side walls of insulating material with each wall extending from said member in closely spaced relation to a respective side of said arcing blade and said contact end in said path to form a narrow arc chamber for said member and said blade, a closed boundary portion between said walls, said boundary portion extending from said member and spaced from said blade end and from said circumferential blade path, said chute having an open end intersecting said circumferential path and extending over a selected angle having an apex at said member for receiving said arcing blade for engagement with said contact member and movement therethrough along said circumferential path with said open end spaced intermediate said contact member and pivot axis and to which expanding arc gases flow in response to the movement of said contact end from said member to disrupt said circuit, each of the side walls having an elongated first vortex generating groove defined by elongate end edges located between said contact member and said open end extending over an angle substantially equal to the selected angle of said open end and intersecting said circumferential path and the flow of expanding arc gases to said open end and substantially parallel to said open end for directing a first portion of said expanding arc gases in a direction intersecting another portion of said expanding arc gas to impede the flow of said expanding gases.

2. A device as claimed in claim 1 wherein each wall has a planar surface and each groove is formed in a respective planar surface, one elongate edge of each groove is a leading edge intermediate said contact portion and open end and another elongate edge of each groove is a rear edge spaced intermediate said leading edge and said open end with a first wall portion in each groove extending from said leading edge transverse to the respective planar surface and said path and toward said rear edge and a concave wall portion merging at one end with the respective first wall portion and extending toward said path and rear edge to direct said first portion of said expanding arc gases in a vortex path intersecting said other portion of said expanding gas.

3. A device as claimed in claim 2 wherein each groove is near said open end of the arc chamber remote from the contact member.

4. A device as claimed in claim 2 wherein each side wall has a second groove with a boundary corresponding to the boundary of the respective first groove, the second groove in each side wall being spaced from the respective first groove in the direction of flow of arc gases and located intermediate the respective first groove and said open end.

5. A device as claimed in claim 4 wherein the first and second grooves in one side wall are respectively opposite a first and a second groove in the other side wall.

6. A device as claimed in claim 4 wherein a portion of the leading edge of the grooves in the side walls are linear and generally parallel to each other.

7. A device as claimed in claim 2 wherein the concave wall portion of each groove is symmetrically located relative said blade path.

8. A device as claimed in claim 1 wherein each wall has a planar surface, and each groove is formed in a respective planar surface and has a semi-teardrop cross section with a relatively shallow inner portion having a convex surface and with a deeper outer portion having a concave surface spaced intermediate said convex surface and said open end.

9. A device as claimed in claim 1 or 8 including a passage in said closed boundary portion spaced from said member and blade path, and a plurality of spaced metallic arc suppression plates in said passage extending radially outwardly of said circumferential path.

* * * * *